US010900108B2

(12) United States Patent
Yoshida et al.

(10) Patent No.: US 10,900,108 B2
(45) Date of Patent: Jan. 26, 2021

(54) METHOD FOR MANUFACTURING BENT ARTICLE USING ALUMINUM ALLOY

(71) Applicant: AISIN KEIKINZOKU CO., LTD., Imizu (JP)

(72) Inventors: Tomoo Yoshida, Toyama (JP); Karin Shibata, Oyabe (JP)

(73) Assignee: AISIN KEIKINZOKU CO., LTD. (JP)

( * ) Notice: Subject to any disclaimer, the term of this patent is extended or adjusted under 35 U.S.C. 154(b) by 227 days.

(21) Appl. No.: 16/101,629

(22) Filed: Aug. 13, 2018

(65) Prior Publication Data

US 2019/0264311 A1 Aug. 29, 2019

(30) Foreign Application Priority Data

Feb. 24, 2018 (JP) ..... 2018-031400

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC ..... C22F 1/053; C22C 21/10
See application file for complete search history.

(56) References Cited

U.S. PATENT DOCUMENTS 7,269,986 B2 * 9/2007 Pfaffmann ..... B21D 26/033 72/342.94
8,105,449 B2 * 1/2012 Yoshida ..... C22C 21/10 148/690
2014/0209223 A1 7/2014 Hashimoto et al.
2018/0087139 A1 3/2018 Hashimoto et al.

FOREIGN PATENT DOCUMENTS

JP 2928445 B2 8/1999
JP 2014125676 A * 7/2014
JP 2014-145119 A 8/2014

OTHER PUBLICATIONS

B.G. Thomas ("Continuous Casting", Encyclopedia of Materials: Science and Technology, pp. 1595-1599, 2001). (Year: 2001).*
JP2014125676A english translation (Year: 2014).*

* cited by examiner

*Primary Examiner* — Anthony J Zimmer
*Assistant Examiner* — Ricardo D Morales
(74) *Attorney, Agent, or Firm* — Harness, Dickey & Pierce, P.L.C.

(57) ABSTRACT

A method for manufacturing a bent article using an aluminum alloy with high strength and excellent corrosion resistance comprises: extruding a cast billet of an aluminum alloy including, by mass, 6.0 to 8.0% Zn, 1.50 to 3.50% Mg, 0.20 to 1.50% Cu, 0.10 to 0.25% Zr, 0.005 to 0.05% Ti, 0.3% or less Mn, 0.25% or less Sr, and the balance Al with inevitable impurities to obtain an extruded material; cooling the extruded material at an average rate of 500° C./min or less immediately after the extrusion processing; subjecting the cooled extruded material to preliminary heating treatment at a temperature within a range of 140 to 260° C. for 30 to 120 seconds within a predetermined time after the extrusion processing; bending the extruded material having undergone the preliminary heating treatment to obtain a bent article; and subjecting the bent article to artificial aging treatment.

7 Claims, 7 Drawing Sheets

FIG. 1A

| | | ALLOY COMPONENTS (MASS%) | | | | | | | | | | Mn+Zr+Sr |
|---|---|---|---|---|---|---|---|---|---|---|---|---|
| | | Si | Fe | Cu | Mn | Mg | Cr | Zn | Zr | Sr | Ti | |
| 1 | EXAMPLE | 0.10 | 0.15 | 0.29 | 0.00 | 2.08 | 0.00 | 6.57 | 0.17 | 0.04 | 0.03 | 0.21 |
| 2 | | 0.05 | 0.15 | 0.29 | 0.00 | 2.40 | 0.00 | 6.65 | 0.20 | 0.04 | 0.03 | 0.24 |
| 3 | | 0.05 | 0.16 | 0.50 | 0.13 | 2.42 | 0.00 | 6.65 | 0.18 | 0.03 | 0.03 | 0.34 |
| 4 | | 0.05 | 0.17 | 0.52 | 0.00 | 2.56 | 0.00 | 6.81 | 0.18 | 0.04 | 0.03 | 0.22 |
| 5 | | 0.04 | 0.15 | 1.00 | 0.00 | 2.50 | 0.00 | 6.70 | 0.18 | 0.04 | 0.03 | 0.22 |
| 6 | | 0.04 | 0.15 | 0.25 | 0.00 | 2.55 | 0.00 | 6.70 | 0.20 | 0.04 | 0.03 | 0.24 |
| 7 | | 0.04 | 0.15 | 0.75 | 0.00 | 2.55 | 0.00 | 6.70 | 0.20 | 0.04 | 0.03 | 0.24 |
| 8 | | 0.04 | 0.15 | 0.50 | 0.00 | 2.50 | 0.00 | 6.70 | 0.20 | 0.00 | 0.03 | 0.20 |
| 9 | | 0.04 | 0.15 | 0.50 | 0.00 | 2.60 | 0.00 | 6.70 | 0.20 | 0.00 | 0.03 | 0.20 |
| 10 | | 0.04 | 0.15 | 0.25 | 0.00 | 2.90 | 0.00 | 6.65 | 0.20 | 0.00 | 0.03 | 0.20 |
| 11 | | 0.04 | 0.15 | 0.25 | 0.20 | 2.90 | 0.00 | 6.65 | 0.20 | 0.00 | 0.03 | 0.40 |
| 12 | | 0.04 | 0.15 | 0.25 | 0.20 | 3.10 | 0.00 | 6.65 | 0.20 | 0.00 | 0.03 | 0.40 |
| 13 | | 0.04 | 0.15 | 0.25 | 0.20 | 3.30 | 0.00 | 6.65 | 0.20 | 0.00 | 0.03 | 0.40 |
| 14 | | 0.05 | 0.13 | 0.24 | 0.23 | 1.73 | 0.01 | 6.77 | 0.20 | 0.00 | 0.02 | 0.43 |
| 15 | | 0.05 | 0.13 | 0.24 | 0.23 | 1.73 | 0.01 | 6.77 | 0.20 | 0.00 | 0.02 | 0.43 |
| 16 | | 0.05 | 0.13 | 0.24 | 0.23 | 1.73 | 0.01 | 6.77 | 0.20 | 0.00 | 0.02 | 0.43 |
| 17 | | 0.05 | 0.13 | 0.24 | 0.23 | 1.73 | 0.01 | 6.77 | 0.20 | 0.00 | 0.02 | 0.43 |
| 18 | | 0.05 | 0.13 | 0.24 | 0.23 | 1.73 | 0.01 | 6.77 | 0.20 | 0.00 | 0.02 | 0.43 |
| 19 | | 0.05 | 0.13 | 0.24 | 0.23 | 1.73 | 0.01 | 6.77 | 0.20 | 0.00 | 0.02 | 0.43 |
| 20 | | 0.05 | 0.13 | 0.24 | 0.23 | 1.73 | 0.01 | 6.77 | 0.20 | 0.00 | 0.02 | 0.43 |
| 21 | | 0.05 | 0.13 | 0.24 | 0.23 | 1.73 | 0.01 | 6.77 | 0.20 | 0.00 | 0.02 | 0.43 |
| 22 | | 0.05 | 0.13 | 0.24 | 0.23 | 1.73 | 0.01 | 6.77 | 0.20 | 0.00 | 0.02 | 0.43 |
| 23 | | 0.05 | 0.13 | 0.24 | 0.23 | 1.73 | 0.01 | 6.77 | 0.20 | 0.00 | 0.02 | 0.43 |
| 24 | | 0.05 | 0.13 | 0.24 | 0.23 | 1.73 | 0.01 | 6.77 | 0.20 | 0.00 | 0.02 | 0.43 |
| 25 | | 0.05 | 0.13 | 0.24 | 0.23 | 1.73 | 0.01 | 6.77 | 0.20 | 0.00 | 0.02 | 0.43 |
| 26 | | 0.05 | 0.13 | 0.24 | 0.23 | 1.73 | 0.01 | 6.77 | 0.20 | 0.00 | 0.02 | 0.43 |
| 27 | | 0.05 | 0.13 | 0.24 | 0.23 | 1.73 | 0.01 | 6.77 | 0.20 | 0.00 | 0.02 | 0.43 |
| 28 | | 0.05 | 0.13 | 0.24 | 0.23 | 1.73 | 0.01 | 6.77 | 0.20 | 0.00 | 0.02 | 0.43 |
| 29 | | 0.05 | 0.13 | 0.24 | 0.23 | 1.73 | 0.01 | 6.77 | 0.20 | 0.00 | 0.02 | 0.43 |
| 30 | | 0.05 | 0.13 | 0.24 | 0.23 | 1.73 | 0.01 | 6.77 | 0.20 | 0.00 | 0.02 | 0.43 |

Cont'd

FIG. 1B

| | | | | | | | | | | | | |
|---|---|---|---|---|---|---|---|---|---|---|---|---|
| 31 | EXAMPLE | 0.05 | 0.13 | 0.24 | 0.23 | 1.73 | 0.01 | 6.77 | 0.20 | 0.00 | 0.02 | 0.43 |
| 32 | | 0.05 | 0.13 | 0.24 | 0.23 | 1.73 | 0.01 | 6.77 | 0.20 | 0.00 | 0.02 | 0.43 |
| 33 | | 0.05 | 0.13 | 0.24 | 0.23 | 1.73 | 0.01 | 6.77 | 0.20 | 0.00 | 0.02 | 0.43 |
| 34 | | 0.06 | 0.16 | 0.20 | 0.20 | 1.62 | 0.01 | 6.40 | 0.17 | 0.00 | 0.02 | 0.37 |
| 35 | | 0.06 | 0.16 | 0.20 | 0.20 | 1.62 | 0.01 | 6.40 | 0.17 | 0.00 | 0.02 | 0.37 |
| 36 | | 0.06 | 0.16 | 0.20 | 0.20 | 1.62 | 0.01 | 6.40 | 0.17 | 0.00 | 0.02 | 0.37 |
| 37 | | 0.06 | 0.16 | 0.20 | 0.20 | 1.62 | 0.01 | 6.40 | 0.17 | 0.00 | 0.02 | 0.37 |
| 38 | | 0.06 | 0.16 | 0.20 | 0.20 | 1.62 | 0.01 | 6.40 | 0.17 | 0.00 | 0.02 | 0.37 |
| 39 | | 0.06 | 0.16 | 0.20 | 0.20 | 1.62 | 0.01 | 6.40 | 0.17 | 0.00 | 0.02 | 0.37 |
| 40 | | 0.06 | 0.16 | 0.20 | 0.20 | 1.62 | 0.01 | 6.40 | 0.17 | 0.00 | 0.02 | 0.37 |
| 41 | | 0.06 | 0.16 | 0.20 | 0.20 | 1.62 | 0.01 | 6.40 | 0.17 | 0.00 | 0.02 | 0.37 |
| 42 | | 0.06 | 0.16 | 0.20 | 0.20 | 1.62 | 0.01 | 6.40 | 0.17 | 0.00 | 0.02 | 0.37 |
| 43 | | 0.06 | 0.16 | 0.20 | 0.20 | 1.62 | 0.01 | 6.40 | 0.17 | 0.00 | 0.02 | 0.37 |
| 44 | | 0.06 | 0.16 | 0.20 | 0.20 | 1.62 | 0.01 | 6.40 | 0.17 | 0.00 | 0.02 | 0.37 |
| 45 | | 0.05 | 0.18 | 0.30 | 0.20 | 1.82 | 0.00 | 6.90 | 0.16 | 0.00 | 0.02 | 0.36 |
| 46 | | 0.05 | 0.18 | 0.30 | 0.20 | 1.82 | 0.00 | 6.90 | 0.16 | 0.00 | 0.02 | 0.36 |
| 47 | | 0.05 | 0.18 | 0.30 | 0.20 | 1.82 | 0.00 | 6.90 | 0.16 | 0.00 | 0.02 | 0.36 |
| 48 | | 0.05 | 0.18 | 0.30 | 0.20 | 1.82 | 0.00 | 6.90 | 0.16 | 0.00 | 0.02 | 0.36 |
| 49 | | 0.05 | 0.18 | 0.30 | 0.20 | 1.82 | 0.00 | 6.90 | 0.16 | 0.00 | 0.02 | 0.36 |
| 50 | | 0.05 | 0.18 | 0.30 | 0.20 | 1.82 | 0.00 | 6.90 | 0.16 | 0.00 | 0.02 | 0.36 |
| 51 | | 0.05 | 0.18 | 0.30 | 0.20 | 1.82 | 0.00 | 6.90 | 0.16 | 0.00 | 0.02 | 0.36 |
| 52 | | 0.05 | 0.18 | 0.30 | 0.20 | 1.82 | 0.00 | 6.90 | 0.16 | 0.00 | 0.02 | 0.36 |
| 53 | | 0.05 | 0.18 | 0.30 | 0.20 | 1.82 | 0.00 | 6.90 | 0.16 | 0.00 | 0.02 | 0.36 |
| 54 | | 0.05 | 0.18 | 0.30 | 0.20 | 1.82 | 0.00 | 6.90 | 0.16 | 0.00 | 0.02 | 0.36 |
| 55 | | 0.05 | 0.18 | 0.30 | 0.20 | 1.82 | 0.00 | 6.90 | 0.16 | 0.00 | 0.02 | 0.36 |
| 56 | COMPARATIVE EXAMPLE | 0.05 | 0.18 | 0.30 | 0.20 | 1.82 | 0.00 | 6.90 | 0.16 | 0.00 | 0.02 | 0.36 |
| 57 | | 0.05 | 0.16 | 2.10 | 0.00 | 2.10 | 0.00 | 5.43 | 0.18 | 0.00 | 0.02 | 0.18 |
| 58 | | 0.05 | 0.17 | 2.16 | 0.00 | 2.03 | 0.00 | 6.69 | 0.18 | 0.00 | 0.02 | 0.18 |
| 59 | | 0.05 | 0.15 | 2.16 | 0.00 | 2.16 | 0.00 | 6.65 | 0.20 | 0.00 | 0.03 | 0.20 |
| 60 | | 0.05 | 0.15 | 2.16 | 0.00 | 2.16 | 0.00 | 6.65 | 0.20 | 0.04 | 0.03 | 0.24 |
| 61 | | 0.05 | 0.15 | 1.60 | 0.26 | 2.50 | 0.26 | 5.60 | 0.00 | 0.00 | 0.03 | 0.26 |
| 62 | | 0.04 | 0.15 | 1.55 | 0.00 | 2.50 | 0.00 | 6.70 | 0.18 | 0.04 | 0.03 | 0.22 |

FIG. 2A

| CASTING CONDITIONS | | BILLET CRYSTALIZED GRAIN DIAMETER | COOLING RATE | PRELIMINARY HEATING TEMPERATURE | PRELIMINARY HEATING TIME | HEAT TREATMENT CONDITIONS | |
|---|---|---|---|---|---|---|---|
| | | | | | | FIRST STAGE | SECOND STAGE |
| | | 250 μm OR LESS | 500°C/MIN OR LESS | 130~260°C | 30~120sec | 90~120°C | 130~180°C |
| 1 | EXAMPLE | 150 | 280 | 200 | 80 | 110 | 140 |
| 2 | | 125 | 280 | 200 | 80 | 110 | 140 |
| 3 | | 150 | 280 | 200 | 80 | 110 | 140 |
| 4 | | 120 | 280 | 200 | 80 | 110 | 140 |
| 5 | | 120 | 280 | 200 | 80 | 110 | 140 |
| 6 | | 110 | 280 | 200 | 80 | 110 | 140 |
| 7 | | 110 | 280 | 200 | 80 | 110 | 140 |
| 8 | | 150 | 300 | 200 | 80 | 110 | 140 |
| 9 | | 180 | 300 | 200 | 80 | 110 | 140 |
| 10 | | 170 | 300 | 200 | 80 | 110 | 140 |
| 11 | | 180 | 300 | 200 | 80 | 110 | 140 |
| 12 | | 170 | 300 | 200 | 80 | 110 | 140 |
| 13 | | 170 | 300 | 200 | 80 | 110 | 140 |
| 14 | | 200 | 140 | 140 | 80 | 110 | 140 |
| 15 | | 200 | 140 | 160 | 80 | 110 | 140 |
| 16 | | 200 | 140 | 180 | 80 | 110 | 140 |
| 17 | | 200 | 140 | 200 | 80 | 110 | 140 |
| 18 | | 200 | 140 | 240 | 80 | 110 | 140 |
| 19 | | 200 | 140 | 140 | 80 | 110 | 140 |
| 20 | | 200 | 140 | 160 | 80 | 110 | 140 |
| 21 | | 200 | 140 | 180 | 80 | 110 | 140 |
| 22 | | 200 | 140 | 200 | 80 | 110 | 140 |
| 23 | | 200 | 140 | 240 | 80 | 110 | 140 |
| 24 | | 200 | 140 | 140 | 80 | 110 | 140 |
| 25 | | 200 | 140 | 160 | 80 | 110 | 140 |
| 26 | | 200 | 140 | 180 | 80 | 110 | 140 |
| 27 | | 200 | 140 | 200 | 80 | 110 | 140 |
| 28 | | 200 | 140 | 240 | 80 | 110 | 140 |
| 29 | | 200 | 140 | 240 | 80 | 110 | 140 |

Cont'd

FIG. 2B

| | | | | | | | |
|---|---|---|---|---|---|---|---|
| 30 | EXAMPLE | 200 | 140 | 240 | 80 | 110 | 140 |
| 31 | | 200 | 140 | 150 | 80 | 110 | 140 |
| 32 | | 200 | 140 | 170 | 80 | 110 | 140 |
| 33 | | 200 | 140 | 190 | 80 | 110 | 140 |
| 34 | | 190 | 140 | 140 | 70 | 105 | 135 |
| 35 | | 190 | 140 | 160 | 70 | 105 | 135 |
| 36 | | 190 | 140 | 180 | 70 | 105 | 135 |
| 37 | | 190 | 140 | 200 | 70 | 105 | 135 |
| 38 | | 190 | 140 | 240 | 70 | 105 | 135 |
| 39 | | 190 | 140 | 140 | 70 | 105 | 135 |
| 40 | | 190 | 140 | 200 | 70 | 105 | 135 |
| 41 | | 190 | 140 | 240 | 70 | 105 | 135 |
| 42 | | 190 | 140 | 140 | 70 | 105 | 135 |
| 43 | | 190 | 140 | 200 | 70 | 105 | 135 |
| 44 | | 190 | 140 | 240 | 70 | 105 | 135 |
| 45 | | 205 | 140 | 140 | 70 | 115 | 145 |
| 46 | | 205 | 140 | 160 | 70 | 115 | 145 |
| 47 | | 205 | 140 | 180 | 70 | 115 | 145 |
| 48 | | 205 | 140 | 200 | 70 | 115 | 145 |
| 49 | | 205 | 140 | 240 | 70 | 115 | 145 |
| 50 | | 205 | 140 | 140 | 70 | 115 | 145 |
| 51 | | 205 | 140 | 200 | 70 | 115 | 145 |
| 52 | | 205 | 140 | 240 | 70 | 115 | 145 |
| 53 | | 205 | 140 | 140 | 70 | 115 | 145 |
| 54 | | 205 | 140 | 200 | 70 | 115 | 145 |
| 55 | | 205 | 140 | 240 | 70 | 115 | 145 |
| 56 | COMPARATIVE EXAMPLE | 205 | 140 | 240 | 70 | 115 | 145 |
| 57 | | 250 | 280 | 200 | 80 | 90 | 160 |
| 58 | | 250 | 280 | 200 | 80 | 90 | 160 |
| 59 | | 250 | 280 | 200 | 80 | 120 | 160 |
| 60 | | 200 | 280 | 200 | 80 | 120 | 160 |
| 61 | | 300 | 280 | 200 | 80 | 90 | 140 |
| 62 | | 150 | 280 | 200 | 80 | 110 | 140 |

FIG. 3A

| | | T1 TENSION STRENGTH [Mpa] | T1 PROOF STRESS [Mpa] | T1 EXTENSION [%] | T5 TENSION STRENGTH [Mpa] | T5 PROOF STRESS [Mpa] | T5 EXTENSION [%] | SCC PROPERTY | SMALL-RADIUS BENDING | MICRO-STRUCTURE SURFACE RECRYSTAL-LIZATION DEPTH |
|---|---|---|---|---|---|---|---|---|---|---|
| | | 350 MPa OR MORE | 200 MPa OR MORE | 15% OR MORE | 480 MPa OR MORE | 460 MPa OR MORE | 10% OR MORE | 720 CYCLES OR MORE | WITHOUT CRACKS AT EXTENSION OF 30% OR MORE | 150 μm OR LESS |
| 1 | EXAMPLE | 486 | 320 | 19 | 568 | 530 | 12.0 | 720 | WITHOUT CRACKS | 50 |
| 2 | | 505 | 339 | 18 | 593 | 550 | 14.0 | 720 | | 50 |
| 3 | | 504 | 340 | 17 | 588 | 550 | 13.0 | 720 | | 50 |
| 4 | | 516 | 350 | 18 | 618 | 580 | 12.5 | 720 | | 50 |
| 5 | | 515 | 345 | 17 | 625 | 585 | 13.0 | 720 | | 20 |
| 6 | | 517 | 347 | 18 | 630 | 587 | 12.5 | 720 | | 20 |
| 7 | | 520 | 350 | 18 | 633 | 589 | 13.0 | 720 | | 20 |
| 8 | | 490 | 320 | 18 | 584 | 548 | 13.0 | 720 | | 20 |
| 9 | | 506 | 340 | 18 | 591 | 553 | 13.0 | 720 | | 20 |
| 10 | | 488 | 310 | 18 | 579 | 540 | 12.0 | 720 | | 20 |
| 11 | | 492 | 321 | 18 | 585 | 554 | 12.0 | 720 | | 20 |
| 12 | | 490 | 312 | 17 | 587 | 542 | 12.0 | 720 | | 20 |
| 13 | | 509 | 338 | 18 | 590 | 545 | 13.0 | 720 | | 20 |
| 14 | | 398 | 247 | 19 | 536 | 505 | 13.1 | 720 OR MORE | | 20 |
| 15 | | 402 | 252 | 16 | 538 | 506 | 13.4 | | | 20 |
| 16 | | 407 | 254 | 18 | 532 | 498 | 13.2 | | | 20 |
| 17 | | 403 | 254 | 16 | 533 | 499 | 12.5 | | | 20 |
| 18 | | 400 | 257 | 17 | 531 | 497 | 12.6 | | | 20 |
| 19 | | 397 | 251 | 19 | 524 | 491 | 12.6 | | | 20 |
| 20 | | 405 | 255 | 19 | 526 | 493 | 13.6 | | | 20 |
| 21 | | 398 | 256 | 18 | 528 | 495 | 13.2 | | | 20 |
| 22 | | 402 | 256 | 17 | 531 | 497 | 12.5 | | | 20 |
| 23 | | 400 | 250 | 17 | 527 | 494 | 13.0 | | | 20 |
| 24 | | 392 | 247 | 16 | 524 | 491 | 12.6 | | | 20 |
| 25 | | 395 | 250 | 20 | 526 | 493 | 13.6 | | | 20 |
| 26 | | 396 | 253 | 17 | 528 | 495 | 13.2 | | | 20 |
| 27 | | 391 | 253 | 18 | 531 | 497 | 12.5 | | | 20 |
| 28 | | 403 | 263 | 19 | 527 | 494 | 13.0 | | | 20 |

Cont'd

FIG. 3B

| | | | | | | | | | | |
|---|---|---|---|---|---|---|---|---|---|---|
| 29 | EXAMPLE | 367 | 233 | 19 | 518 | 492 | 12.9 | 720 OR MORE | WITHOUT CRACKS | 20 |
| 30 | | 389 | 247 | 16 | 520 | 494 | 13.9 | | | 20 |
| 31 | | 348 | 220 | 15 | 518 | 485 | 13.2 | | | 20 |
| 32 | | 362 | 239 | 14 | 521 | 490 | 12.4 | | | 20 |
| 33 | | 368 | 247 | 18 | 517 | 482 | 12.8 | | | 20 |
| 34 | | 379 | 232 | 16 | 516 | 483 | 13.0 | | | 50 |
| 35 | | 380 | 234 | 18 | 503 | 470 | 12.7 | | | 50 |
| 36 | | 385 | 237 | 17 | 520 | 496 | 13.5 | | | 50 |
| 37 | | 379 | 243 | 15 | 521 | 489 | 13.5 | | | 50 |
| 38 | | 373 | 240 | 18 | 508 | 475 | 13.2 | | | 50 |
| 39 | | 387 | 232 | 17 | 517 | 487 | 13.0 | | | 50 |
| 40 | | 380 | 234 | 16 | 518 | 491 | 13.5 | | | 50 |
| 41 | | 378 | 233 | 16 | 520 | 488 | 13.3 | | | 50 |
| 42 | | 411 | 259 | 17 | 545 | 510 | 13.5 | | | 70 |
| 43 | | 410 | 260 | 16 | 538 | 503 | 12.7 | | | 70 |
| 44 | | 412 | 263 | 15 | 539 | 504 | 13.5 | | | 70 |
| 45 | | 416 | 260 | 16 | 540 | 506 | 12.5 | | | 70 |
| 46 | | 417 | 259 | 17 | 540 | 510 | 12.6 | | | 70 |
| 47 | | 418 | 261 | 15 | 544 | 509 | 12.0 | | | 70 |
| 48 | | 413 | 263 | 17 | 541 | 507 | 12.4 | | | 70 |
| 49 | | 411 | 265 | 17 | 539 | 509 | 12.5 | | | 70 |
| 50 | | 417 | 263 | 17 | 543 | 509 | 12.5 | | | 70 |
| 51 | | 416 | 263 | 18 | 540 | 511 | 12.4 | | | 70 |
| 52 | | 416 | 264 | 18 | 537 | 510 | 12.3 | | | 70 |
| 53 | | 411 | 259 | 17 | 545 | 510 | 13.5 | | | 70 |
| 54 | | 410 | 260 | 16 | 538 | 503 | 12.7 | | | 70 |
| 55 | | 412 | 263 | 15 | 539 | 504 | 13.5 | | | 70 |
| 56 | COMPARATIVE EXAMPLE | 422 | 283 | 16 | 540 | 505 | 13.2 | | WITH CRACKS | 70 |
| 57 | | 375 | 231 | 18 | 547 | 472 | 14.4 | 240 | WITHOUT CRACKS | 20 |
| 58 | | 480 | 315 | 18 | 580 | 530 | 13.6 | 240 | WITH CRACKS | 20 |
| 59 | | 475 | 318 | 18 | 576 | 526 | 13.0 | 240 | | 220 |
| 60 | | 475 | 318 | 18 | 591 | 544 | 11.0 | 240 | | 100 |
| 61 | | 475 | 318 | 18 | 517 | 446 | 14.0 | 240 | | 200 |
| 62 | | 475 | 318 | 18 | 590 | 545 | 13.0 | 240 | | 200 |

METHOD FOR MANUFACTURING BENT ARTICLE USING ALUMINUM ALLOY

The content of JP-A-2018-031400 filed on Feb. 24, 2018 is incorporated in this application.

BACKGROUND

The present invention relates to a method for manufacturing a bent article of an aluminum alloy excellent in strength and corrosion resistance.

The 7000-series aluminum alloys such as Al—Zn—Mg and Al—Zn—Mg—Cu make it possible to manufacture high-strength products but are poor in extrusion processability.

In addition, the 7000-series aluminum alloys are insufficient in stress corrosion cracking resistance in a bending process or the like, and improvement in corrosion resistance has been required of these alloys.

According to the techniques described in JP-A-2014-145119 and Japanese Patent No. 2928445, a transition element such as Mn, Cr, or Zr is added to the 7000-series aluminum alloys to reduce the recrystallization depth of the surface of an extruded material and the size of recrystallized grains in extrusion processing.

However, the 7000-series aluminum alloy with Cr as a transition element has high quenching sensitivity in extrusion processing. Accordingly, unless subjected to rapid cooling such as water cooling in the process of cooling immediately after the extrusion (called die end quenching), the 7000-series aluminum alloy cannot possess sufficiently high strength and the extruded material is likely to become deformed or warped in cross section.

In addition, the Cr-added 7000-series aluminum alloy is likely to become cracked in a bending process.

According to JP-A-2014-145119, the Cr-added 7000-series aluminum alloy is subjected to restoration heat treatment up to the solution temperature, and thus is also likely to cause a problem in stress corrosion cracking resistance.

SUMMARY

An object of the present invention is to provide a method for manufacturing a bent article using an aluminum alloy with high strength and excellent corrosion resistance.

An aspect of the present invention relates to a method for manufacturing a bent article using an aluminum alloy comprising: extruding a cast billet of an aluminum alloy including, by mass, 6.0 to 8.0% Zn, 1.50 to 3.50% Mg, 0.20 to 1.50% Cu, 0.10 to 0.25% Zr, 0.005 to 0.05% Ti, 0.3% or less Mn, 0.25% or less Sr, and the balance Al with inevitable impurities to obtain an extruded material; cooling the extruded material at an average rate of 500° C./min or less immediately after the extrusion processing; subjecting the cooled extruded material to preliminary heating treatment at a temperature within a range of 140 to 260° C. for 30 to 120 seconds within a predetermined time after the extrusion processing; bending the extruded material having undergone the preliminary heating treatment to obtain a bent article; and subjecting the bent article to artificial aging treatment.

In the aspect of the present invention, the aluminum alloy preferably has a total amount of Mn+Zr+Sr within a range of 0.10 to 0.50%.

In the aspect of the present invention, the cast billet preferably has an average crystalized grain diameter of 250 μm or less.

BRIEF DESCRIPTION OF THE DRAWINGS

FIGS. 1A and 1B show the chemical compositions of aluminum alloys used in evaluation.

FIGS. 2A and 2B show the crystalized grain diameters and manufacturing conditions of billets used in evaluation.

FIGS. 3A and 3B show evaluation results.

DESCRIPTION OF EXEMPLARY EMBODIMENTS

Figure 4B:
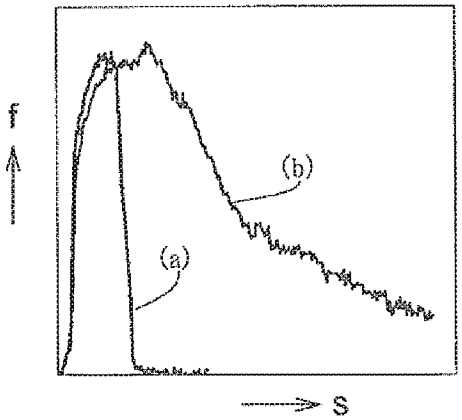
FIG. 4A illustrates a bending property test method and FIG. 4B illustrates an example of comparison between displacement-load curves.

An object of the present invention is to provide a method for manufacturing a bent article using an aluminum alloy with high strength and excellent corrosion resistance.

An embodiment of a method for manufacturing a bent article using an aluminum alloy according to the present invention is characterized in comprising: extruding a cast billet of an aluminum alloy including, by mass, 6.0 to 8.0% Zn, 1.50 to 3.50% Mg, 0.20 to 1.50% Cu, 0.10 to 0.25% Zr, 0.005 to 0.05% Ti, 0.3% or less Mn, 0.25% or less Sr, and the balance Al with inevitable impurities to obtain an extruded material; cooling the extruded material at an average rate of 500° C./min or less immediately after the extrusion processing; subjecting the cooled extruded material to preliminary heating treatment at a temperature within a range of 140 to 260° C. for 30 to 120 seconds within a predetermined time after the extrusion processing; bending the extruded material having undergone the preliminary heating treatment to obtain a bent article; and subjecting the bent article to artificial aging treatment.

In the embodiment of the present invention, the aluminum alloy preferably has a total amount of Mn+Zr+Sr within a range of 0.10 to 0.50%.

In the embodiment of the present invention, the cast billet preferably has an average crystalized grain diameter of 250 μm or less.

The cast billet can be casted at a casting rate of 50 mm/min or more to increase the cooling rate and decrease the crystalized grain diameter of the structure.

This chemical composition of the aluminum alloy is selected for the following reasons:

(1) Zn

Zn is effective in achieving high strength while suppressing degradation in the extrusion property of the aluminum alloy.

However, the addition amount of Zn is set within a range of 6.0 to 8.0% because an addition amount exceeding 8.0% might be a cause of deterioration in stress corrosion cracking resistance.

(2) Mg

Mg is most effective in achieving high strength of the extruded material. However, the addition amount of Mg preferably falls within a range of 1.50 to 3.50% because too large an addition amount would degrade the extrusion property and bending formability of the aluminum alloy.

Although Mg is affected by Cu as described later, the addition amount of Mg is preferably 2.0% or more, more preferably 2.5% or more, to ensure a proof stress (0.2% proof stress) of 480 MPa or more.

(3) Cu

Cu can be expected to improve the strength of the aluminum alloy by the effect of solid solution hardening with aluminum. However, the addition amount of Cu preferably falls within a range of 0.20 to 1.50% because Cu may cause general corrosion due to a local potential difference and degrade the extrusion processability and bending processability of the aluminum alloy.

To ensure a proof stress of 500 MPa or more, the addition amount of Cu is 0.5% or more, preferably 0.75% or more, and further preferably 1.0% or more, although being affected by Mg as described above.

(4) Zr and Mn

Zr is a transition element that allows air cooling immediately after extrusion processing and suppresses the recrystallization depth of the surface of the extruded material in extrusion processing at a cooling rate of 500° C./min or less, even 100 to 300° C./min.

This makes it easy to ensure the stress corrosion cracking resistance and high strength of the aluminum alloy.

Mn is a transition element that is expected to reduce the recrystallization depth of the surface of the extruded material in extrusion processing. Mn may be added in a range of 0.30% or less.

Mn is preferably added within a range of 0.10 to 0.30%.

In contrast, Cr increases sensitivity to die end quenching and requires rapid cooling such as water cooling, and thus Cr is preferably not included in the embodiment of the present invention.

If included, Cr is preferably suppressed to 0.05% or less as an inevitable impurity.

(5) Sr

Sr suppresses coarsening of crystalized grains at the time of casting a billet and suppresses recrystallization on the surface of the extruded material in extrusion processing.

Although Sr is not an essential component in the embodiment of the present invention, Sr may be added within a range of 0.25% or less.

When the addition amount of Sr exceeds 0.25%, the crystalized product with Sr as a seed may become coarsened.

Sr is preferably added within a range of 0.03 to 0.25%.

The total amount of Mn+Zr+Sr preferably falls within a range of 0.10 to 0.50%.

(6) Ti

Ti is effective in making crystalized grains finer at the time of casting a billet. Ti is preferably added within a range of 0.005 to 0.05%.

(7) Other Components

In the embodiment of the present invention, inevitable impurities other than the foregoing components are preferably decreased as much as possible.

In particular, Fe and Si are likely to be mixed at the time of casting a billet, and Fe is preferably suppressed to 0.2% or less and Si is preferably suppressed to 0.1% or less.

Larger amounts of Fe and Si would decrease the strength of the aluminum alloy and deteriorate the stress corrosion cracking resistance and bending formability of the aluminum alloy.

Next, a manufacturing process will be described.

(1) A molten aluminum alloy with the chemical composition described above is prepared to cast a columnar billet.

As a casting method, a continuous casting method such as float-type casting or hot-top casting is used, and the cooling rate is set such that the casting rate becomes 50 mm/min or more.

(2) The casted columnar billet is subjected to homogenization treatment (homo treatment) at a temperature of 470 to 530° C. for two to 24 hours.

The average crystalized grain diameter of the cast billet according to the embodiment of the present invention can be 250 μm or less.

(3) The extrusion of the billet is performed using a direct extruder, an indirect extruder, or the like.

The billet is pre-heated to a temperature of 400 to 500° C. and extruded.

The extruded material extracted from the die (mold) of the extruder is at a high temperature of 500 to 580° C.

Then, the extruded material is subjected to quenching treatment by cooling immediately after the extrusion.

This is generally called die end quenching.

In the embodiment of the present invention, the extruded material can be sufficiently quenched at a cooling rate of 50 to 500° C./min, and therefore the die end quenching can be performed by air cooling such as fan cooling.

This makes it possible to suppress deformation of the extruded material such as strain or warp and simplify cooling equipment as compared to the case of conventional water cooling.

The cooling rate here refers to a cooling rate until the temperature of the extruded material reaches 200° C. or lower.

(4) The thus processed extruded material is then bent according to the product shape or the preliminary shape prior to the product shape.

The extruded material can be bent by various methods such as press bending and vendor bending.

The bending process is performed after the extruded material is pre-heated at a temperature increase rate of 1.8° C./sec or more, a pre-heating temperature of 140 to 260° C., and for a pre-heating time of 30 to 120 sec.

(5) Next, the extruded material is subjected to artificial aging treatment.

The artificial aging treatment refers to performing predetermined heating treatment to precipitate elements out of the aluminum alloy for a higher strength.

In the embodiment of the present invention, the artificial aging treatment can be performed under artificial aging treatment conditions applied to 7000-series aluminum alloys.

In this example, two-stage aging treatment is performed at a temperature of 90 to 120° C. for one to 24 hours in the first stage and at a temperature of 130 to 180° C. for one to 24 hours in the second stage.

The aluminum alloy used for the bent article according to the embodiment of the present invention has favorable hardenability, and can be made highly strong by air cooling, with a tension strength of 480 MPa or more and a 0.2% proof stress of 460 MPa or more.

The aluminum alloy according to the embodiment of the present invention is also excellent in stress corrosion cracking resistance.

The use of the manufacturing process according to the embodiment of the present invention makes it possible to obtain a bent article that is excellent in bending formability, strength, and stress corrosion cracking resistance.

Various kinds of chemical compositions of aluminum alloys were prepared, tested, and evaluated by comparison in manufacturing process. The evaluation results will be described below.

The table in FIGS. 1A and 1B shows the chemical compositions of aluminum alloys according to examples 1 to 55 of the present invention, and the chemical compositions of aluminum alloys according to comparative examples 56 to 62.

The comparative example 57 contains 5.43% Zn that falls under the lower limit of 6.0% of the present invention.

The comparative examples 58 to 62 contain Cu components that exceed the upper limit of 1.50% of the present invention.

The comparative example 61 contains additional 0.26% Cr.

FIGS. 2A and 2B show manufacturing conditions and others.

The aluminum alloys shown in the table of FIGS. 1A and 1B were molten to continuously cast columnar billets by hot-top casting at a casting rate of 70 to 80 mm/min higher than 50 mm/min or more.

Next, the cast billets were subjected to homogenization treatment at a temperature of 480 to 520° C.

Samples were cut out of the cast billets, and the surfaces of the samples were mirror-polished. Then, the samples were etched by Keller's reagent, and the average crystalized grain diameters of the cast billets were measured by an optical microscope.

The measurement results of the average crystalized grain diameters of the cast billets are shown in the section "Billet crystalized grain diameter" of the table in FIGS. 2A and 2B.

The thus manufactured billets were pre-heated to a temperature of 400 to 500° C. and extruded.

In this instance, the extruded materials were air-cooled under a cooling condition of 500° C./min or less immediately after the extrusion as die end quenching.

The cooling rates are shown in the section "Cooling rate" of the table in FIGS. 2A and 2B.

The thus obtained extruded materials were pre-heated with temperature increase at a rate of 1.8° C./sec or more to the pre-heating temperatures described in the table in FIGS. 2A and 2B, held for the pre-heating times shown in the table, and then bent.

The pre-heating treatment is intended to reduce stress strain caused at the time of bending of the extruded materials, but there is no limitation on the bending shape.

The bending shape can be a bow shape, for example.

The aluminum alloy according to the embodiment of the present invention is a natural aging hardening material, and thus is preferably bent within about one week after the extrusion processing.

Then, the bent articles were subjected to two-stage artificial aging treatment under the heat treatment conditions shown in the table of FIGS. 2A and 2B.

Test pieces were cut out of the thus obtained bent articles and were evaluated for various items. The table of FIGS. 3A and 3B shows the evaluation results.

The evaluation items and the evaluation method are as described below.

(1) Mechanical Properties

No. 5 tension test pieces were prepared under Japanese Industrial Standard JIS-Z2241 and tested in tension by a tension tester in conformity with the JIS standard.

Referring to the table, T1 tension strength, T1 proof stress (0.2%), and T1 extension represent values of a T1 material before the artificial aging treatment, and T5 tension strength, T5 proof stress (0.2%), and T5 extension represent values of a T5 material after the artificial aging treatment.

In the embodiment of the present invention, the formed articles are automobile components and structure materials. Therefore, the target values of their mechanical properties, that is, SCC property, small-radius bending, and surface recrystallization depth described later are shown for reference in the table of FIGS. 3A and 3B.

(2) SCC Property (Stress Corrosion Cracking Resistance)

Under a stress of 80% relative to the proof stress, the test pieces were subjected to 720 cycles of a process described later. Test pieces without cracks were regarded to attain the target. For test pieces with cracks in a smaller number of cycles, the numbers of cycles in which cracking occurred are shown in the table of FIGS. 3A and 3B.

<One Cycle>

The test pieces were immersed with a water solution of 3.5% NaCl at 25° C. for 10 minutes, then left at 25° C. and a humidity of 40% for 50 minutes, and then let dry naturally.

(3) Small-Radius Bending (Bending Property)

The product manufactured from the aluminum alloy according to the embodiment of the present invention by the manufacturing process according to the embodiment of the present invention is unlikely to become cracked even if being bent in a small-radius shape (small-radius bending).

Figure 4A:
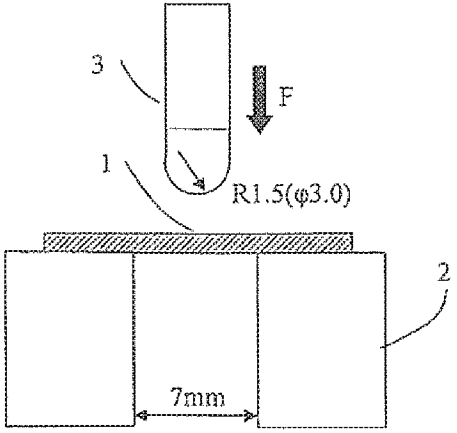

The test pieces were subjected to a bending test by the method described in FIG. 4A.

A 20×150 mm test piece 1 with a thickness of 2 mm was cut out and placed on a jig 2 with a space of 7 mm, and was brought under a load by a punch 3 semicircular in cross section with a tip radius of 1.5 mm.

Under these bending conditions, the extension ratio of the bent tip is about 30%.

FIG. 4B illustrates displacement-load curves with a displacement (s) at the time of application of a load to the test piece 1 by the punch 3 on the lateral axis and the load (f) on the vertical axis.

A curve (a) in the graph indicates a case with cracks in the bent tip, which shows that the load steeply dropped down in the event of cracks.

In contrast to this, as shown in a curve (b), the test pieces without cracks contain viscous materials and the load gradually dropped down when the test pieces were being bent.

The evaluation results in the presence or absence of cracks are shown in the section "Small-radius bending" of the table in FIGS. 3A and 3B.

(4) Surface Recrystallization Depth

The cross sections of the extruded materials were mirror-polished, etched in a water solution of 3% NaOH, and then the thickness of recrystallized structure on the surfaces of the extruded materials were measured by an optical microscope.

The evaluation results of thickness of recrystallized structures are shown in the section "Surface recrystallization depth" of the table in FIGS. 3A and 3B.

The evaluation results of the mechanical properties, SCC property (stress corrosion cracking resistance), small-radius bending (bending property), and surface recrystallization depth will be discussed below.

The examples 1 to 55 attained all the targets.

The comparative example 56 had the chemical composition of the aluminum alloy within the range set herein and thus attained the targets of tension strength, proof stress, and SCC property.

However, the comparative example 56 became cracked at the small-radius bending test, possibly because the example was left for about nine days after the extrusion processing and has aged naturally in the meantime.

From this, the extruded material is preferably bent within seven days after the extrusion processing to ensure excellent bending property.

The comparative examples 57 to 62 did not reach the target of SCC property.

The comparative examples 58 to 62 became cracked at the time of small-radius bending.

The comparative examples 59, 61, and 62 did not reach the target of SCC property because they had amounts of Cu beyond the upper limit. Among them, the comparative example 61 contained 0.26% Cr and thus was as low in proof stress as 446 MPa.

The aluminum alloy used in the present invention is of high strength and has excellent stress corrosion cracking resistance, and is applicable to a wide range of items such as automobile components and machine structural materials requiring high strength and corrosion resistance.

According to the process of the present invention, it is possible to obtain a bent article excellent in bending cracking resistance.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A method for manufacturing a bent article using an aluminum alloy, comprising:

extruding a cast billet of an aluminum alloy including, by mass, 6.0 to 8.0% Zn, 1.50 to 3.50% Mg, 0.20 to 1.50% Cu, 0.10 to 0.25% Zr, 0.005 to 0.05% Ti, 0.3% or less Mn, 0.25% or less Sr, and the balance Al with inevitable impurities to obtain an extruded material;

cooling the extruded material by fan cooling at an average rate of 500° C./min or less immediately after the extrusion processing;

subjecting the cooled extruded material to preliminary heating treatment at a temperature increase rate of 1.8° C./sec or more, and at a temperature within a range of 140 to 260° C. for 30 to 120 seconds within a predetermined time after the extrusion processing;

bending the extruded material having undergone the preliminary heating treatment by press bending or vendor bending to obtain a bent article; and subjecting the bent article to artificial aging treatment.

2. The method for manufacturing a bent article using an aluminum alloy as defined in claim 1, the aluminum alloy has a total amount of Mn+Zr+Sr within a range of 0.10 to 0.50%.

3. The method for manufacturing a bent article using an aluminum alloy as defined in claim 2, the cast billet has an average crystalized grain diameter of 250 μm or less.

4. The method for manufacturing a bent article using an aluminum alloy as defined in claim 3, the bent article having undergone the artificial aging treatment has a tension strength of 480 MPa or more and a 0.2% proof stress of 460 MPa or more.

5. The method for manufacturing a bent article using an aluminum alloy as defined in claim 1, the preliminary heating treatment is performed within a range of 140 to 240° C.

6. The method for manufacturing a bent article using an aluminum alloy as defined in claim 1, the cast billet of an aluminum alloy includes, by mass, 6.0 to 8.0% Zn, 1.50 to 3.50% Mg, 0.20 to 1.50% Cu, 0.10 to 0.25% Zr, 0.005 to 0.05% Ti, 0.3% or less Mn, 0.03 to 0.25% Sr, and the balance Al with inevitable impurities.

7. The method for manufacturing a bent article using an aluminum alloy as defined in claim 1, the cast billet of an aluminum alloy includes, by mass, 6.0 to 8.0% Zn, 1.50 to 3.50% Mg, 0.20 to 1.50% Cu, 0.10 to 0.25% Zr, 0.03 to 0.05% Ti, 0.3% or less Mn, 0.25% or less Sr, and the balance Al with inevitable impurities.

* * * * *